US008360605B2

(12) United States Patent
Venhaus

(10) Patent No.: US 8,360,605 B2
(45) Date of Patent: Jan. 29, 2013

(54) LED LUMINAIRE

(75) Inventor: David A. Venhaus, West Allis, WI (US)

(73) Assignee: Illumination Optics Inc., Wauwatosa, WI (US)

( * ) Notice: Subject to any disclaimer, the term of this patent is extended or adjusted under 35 U.S.C. 154(b) by 49 days.

(21) Appl. No.: 13/103,704

(22) Filed: May 9, 2011

(65) Prior Publication Data

US 2011/0273878 A1 Nov. 10, 2011

Related U.S. Application Data

(60) Provisional application No. 61/395,201, filed on May 9, 2010.

(51) Int. Cl.
*F21V 11/00* (2006.01)

(52) U.S. Cl. ..... 362/235; 362/241; 362/247; 362/297; 362/305; 362/346

(58) Field of Classification Search ..... 362/297, 362/304, 305, 241, 247, 235, 147, 346
See application file for complete search history.

(56) References Cited

U.S. PATENT DOCUMENTS

| | | | |
|---|---|---|---|
| 4,974,137 | A | 11/1990 | Evans, Jr. |
| 5,272,570 | A | 12/1993 | Yoshida et al. |
| 5,704,709 | A | 1/1998 | Zwick et al. |
| 6,318,886 | B1 | 11/2001 | Stopa et al. |
| 6,457,850 | B2 | 10/2002 | Oyama et al. |
| 6,502,963 | B1 | 1/2003 | King |
| 6,601,970 | B2 | 8/2003 | Ueda et al. |
| 6,641,284 | B2 | 11/2003 | Stopa et al. |
| 6,796,695 | B2 | 9/2004 | Natsume |
| 6,814,480 | B2 | 11/2004 | Amano |
| 6,848,820 | B2 | 2/2005 | Natsume |
| 6,945,672 | B2 | 9/2005 | Du et al. |
| 6,966,675 | B2 | 11/2005 | Albou |
| 7,040,782 | B2 | 5/2006 | Mayer |

(Continued)

FOREIGN PATENT DOCUMENTS

| | | | |
|---|---|---|---|
| JP | 18294598 | A | 10/2006 |
| JP | 19080565 | A | 3/2007 |

(Continued)

OTHER PUBLICATIONS

Fig. 2.1 Plan Review of Roadway Coverage for Different Types of Luminaries, Oct. 16, 2007, Retrieved from the Iowa Statewide Urban Design and Specifications Web site, Chapter 11, Section 2, p. 11: http://www.iowasudas.org/documents/Ch11Sect2-07.pdf.

(Continued)

*Primary Examiner* — Ali Alavi
(74) *Attorney, Agent, or Firm* — Michael Best & Friedrich LLP

(57) ABSTRACT

A luminaire for lighting an area includes at least one LED and a first reflector disposed substantially within the housing. The first reflector includes an annular reflective surface having a central axis and an edge defining an aperture through which light exits. The annular surface is formed from a first conic cross section portion revolved about the central axis with one of the at least one LED facing the central axis and positioned proximate a focal point of the first conic cross section portion. The luminaire also includes a second reflector within the housing. The second reflector has a bottom reflective surface that is formed from a second conic cross section portion extending to and revolved about the central axis. The focal point of the second conic cross section portion is proximate the one of the at least one LED.

20 Claims, 12 Drawing Sheets

U.S. PATENT DOCUMENTS

| | | | | |
|---|---|---|---|---|
| 7,156,544 | B2 | 1/2007 | Ishida | |
| 7,160,004 | B2 | 1/2007 | Peck | |
| 7,178,960 | B2 | 2/2007 | Ishida | |
| 7,207,697 | B2 | 4/2007 | Shoji | |
| 7,213,949 | B2 | 5/2007 | Ford et al. | |
| 7,261,439 | B2 | 8/2007 | Sormani et al. | |
| 7,270,449 | B2 | 9/2007 | Uke | |
| 7,470,042 | B2 | 12/2008 | Ayabe et al. | |
| 7,568,821 | B2 | 8/2009 | Peck et al. | |
| 7,578,600 | B2 | 8/2009 | Czajkowski | |
| 7,585,096 | B2 | 9/2009 | Fallahi et al. | |
| 7,597,465 | B2 | 10/2009 | Inaba et al. | |
| 7,604,384 | B2 * | 10/2009 | Peck | 362/517 |
| 7,658,513 | B2 * | 2/2010 | Peck | 362/298 |
| 7,665,866 | B2 * | 2/2010 | Mayer et al. | 362/297 |
| 7,794,119 | B2 | 9/2010 | Venhaus | |
| 2005/0157490 | A1 | 7/2005 | Klose | |
| 2005/0213336 | A1 | 9/2005 | Ford et al. | |
| 2006/0044808 | A1 | 3/2006 | Gorres | |
| 2006/0087860 | A1 | 4/2006 | Ishida | |
| 2006/0198148 | A1 | 9/2006 | Peck | |
| 2006/0209270 | A1 | 9/2006 | Suzuki | |
| 2006/0268555 | A1 | 11/2006 | Kelly | |
| 2007/0002572 | A1 | 1/2007 | Ewig et al. | |
| 2007/0247856 | A1 | 10/2007 | Wang et al. | |
| 2008/0247170 | A1 | 10/2008 | Peck | |
| 2009/0034271 | A1 | 2/2009 | Gorres et al. | |
| 2009/0034272 | A1 | 2/2009 | Gorres et al. | |
| 2009/0067172 | A1 | 3/2009 | Inoue et al. | |
| 2010/0157607 | A1 | 6/2010 | Venhaus | |

FOREIGN PATENT DOCUMENTS

| | | | |
|---|---|---|---|
| WO | 9817944 | A1 | 4/1998 |
| WO | 2005036054 | A1 | 4/2005 |

OTHER PUBLICATIONS

International Search Report and Written Opinion for corresponding International Application No. PCT/US2008/062614 mailed on Oct. 16, 2008.

* cited by examiner

LED LUMINAIRE

RELATED APPLICATION DATA

The present application claims priority under 35 U.S.C. §119 to Provisional Patent Application No. 61/395,201 filed May 9, 2010, the disclosure of which is hereby incorporated by reference.

BACKGROUND

The present invention relates to solid state lighting, such as light emitting diode (LED) lighting, and more particularly to a LED luminaire.

SUMMARY

LEDs provide several advantages over conventional lighting sources, such as reduced power consumption, higher efficiency, longer life, and enhanced aesthetics. But unlike conventional omnidirectional incandescent, metal halide, sodium, or fluorescent lights, LEDs are directional in nature and require optics specifically configured to optimize the spread of light over a given area in order to meet the light output patterns necessary for many applications. One such application is classified by the Illuminating Engineering Society of North America (IESNA) as a Type V light distribution. The distribution of light for a Type V fixture when viewed from above is typically substantially circular. A Type V light also requires a light pattern with a large increase in light beam candela (luminous intensity) as the angle from the nadir increases. For example, the luminous intensity for a desired target area at angles approaching 50-70 degrees from nadir needs to be three to six times that at the nadir. A typical cross section polar plot of a Type V light so configured illustrates what is commonly referred to as a "batwing" pattern, and an optical system providing such a pattern with the aforementioned Type V characteristics in a fixture utilizing LEDs offers benefits for several lighting applications, to include both low bay and high bay lighting.

In one embodiment of a luminaire for lighting an area, the luminaire includes at least one LED and a first reflector disposed substantially within the housing. The first reflector includes an annular reflective surface having a central axis and an edge defining an aperture through which light exits. The aperture defines a transverse distance D. The annular surface is formed from a first conic cross section portion revolved about the central axis with one of the at least one LED facing the central axis and positioned proximate a focal point of the first conic cross section portion. The first conic cross section portion has a focal length between about 0.75 of transverse distance D and about 1.0 of transverse distance D. The luminaire also includes a second reflector within the housing. The second reflector has a bottom reflective surface that is formed from a second conic cross section portion extending to and revolved about the central axis. The focal point of the second conic cross section portion is proximate the one of the at least one LED.

In another embodiment of a luminaire for lighting an area, the luminaire includes at least one LED and a first reflector disposed substantially within the housing. The first reflector includes an annular reflective surface having a central axis. The annular surface is formed from a first conic cross section portion revolved about the central axis. The first conic cross section portion has a first conic cross section portion vertex with one of the at least one LED facing the central axis and substantially toward the first conic cross section portion vertex. The one of the at least one LED is further positioned proximate a focal point of the first conic cross section portion. The luminaire also includes a second reflector within the housing. The second reflector has a bottom reflective surface that is formed from a second conic cross section portion extending to and revolved about the central axis. The second conic cross section portion has a second conic cross section portion vertex, wherein the focal point of the second conic cross section portion is proximate the one of the at least one LED and the one of the at least one LED faces substantially away from the second conic cross section portion vertex.

Other aspects of the invention will become apparent by consideration of the detailed description and accompanying drawings.

BRIEF DESCRIPTION OF THE DRAWINGS

FIG. 6 is a modified cross section showing details of the formation of the reflector of FIG. 5*a*.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
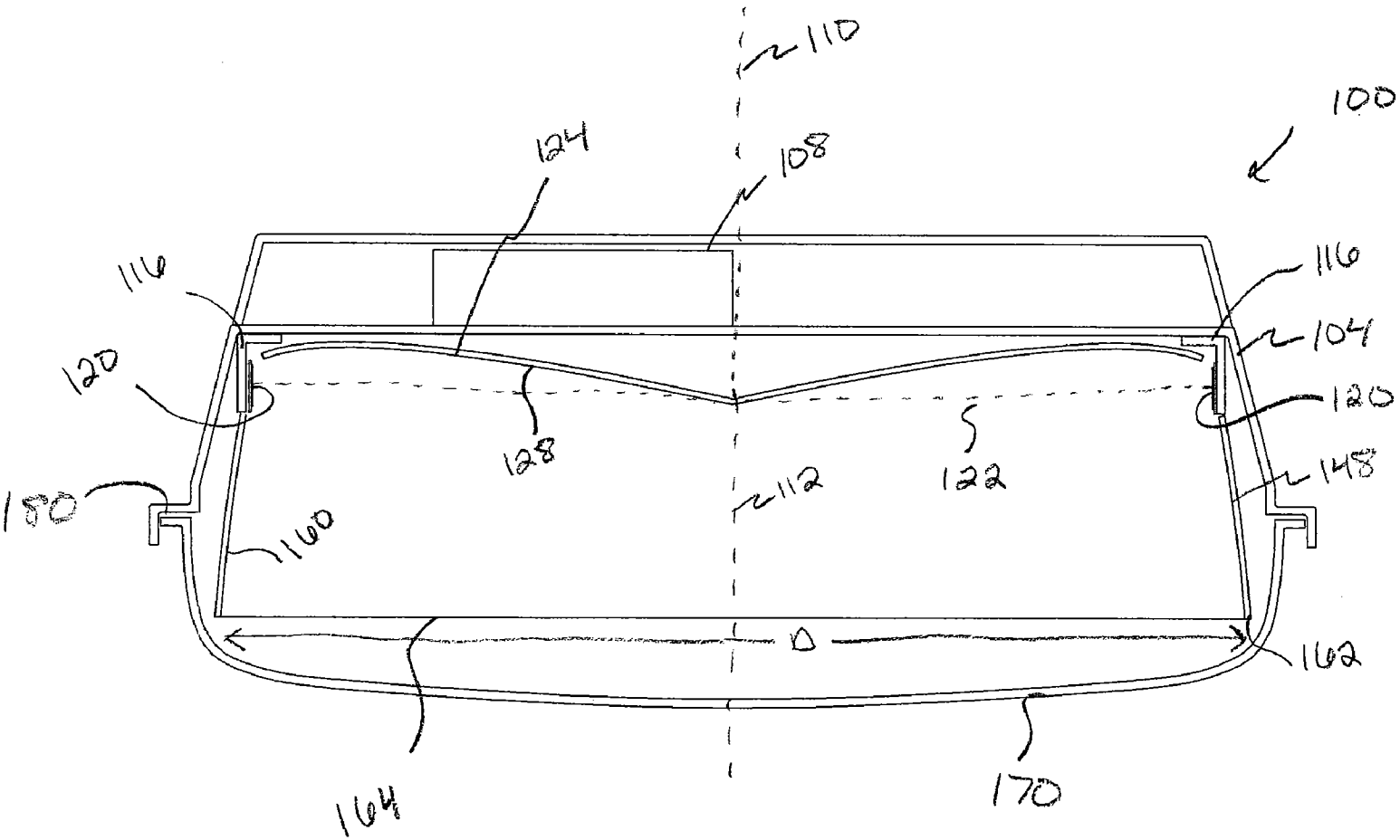
FIG. 1 is a cross section of a luminaire embodying the present invention.
Figure 2:
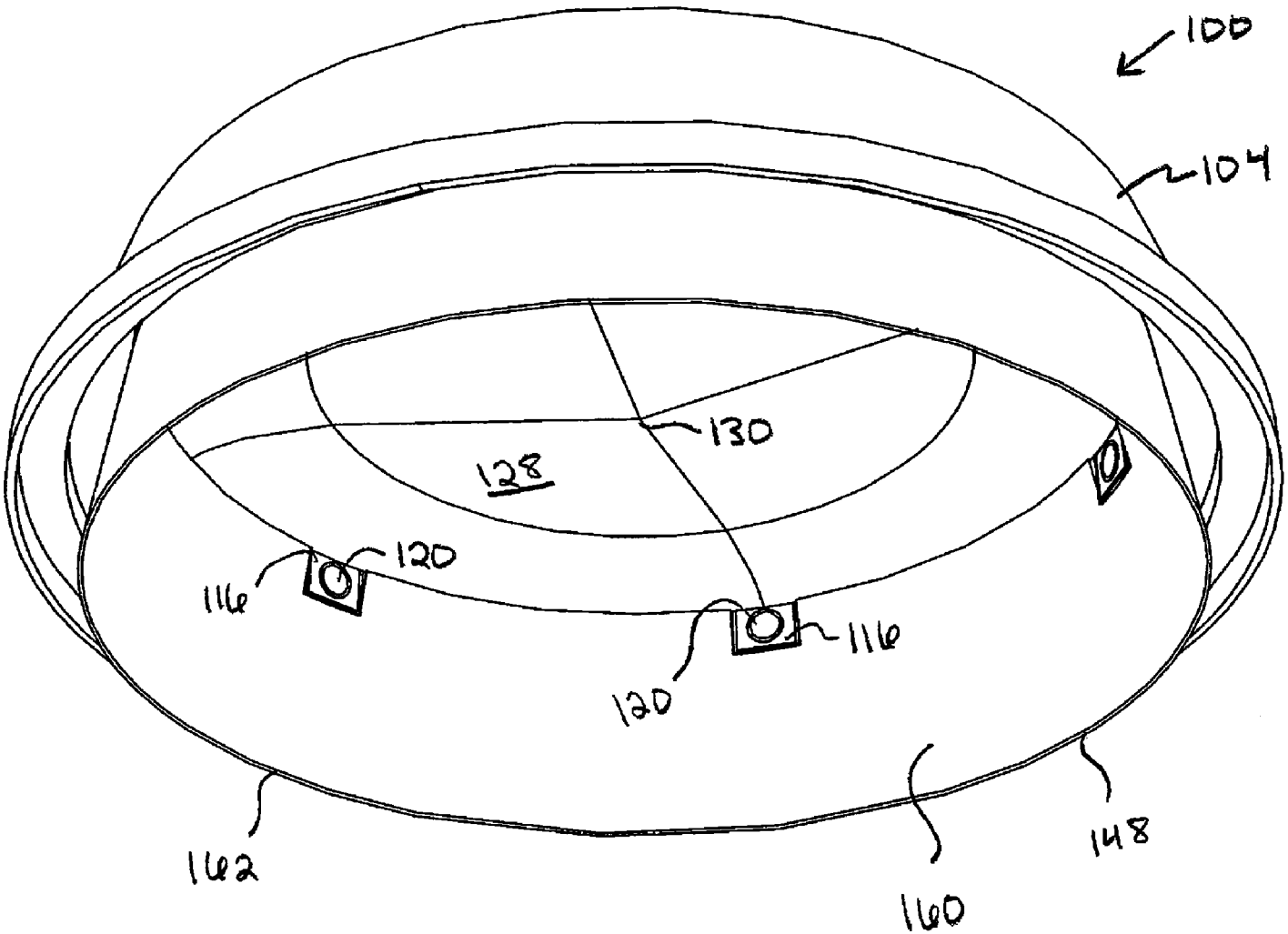
FIG. 2 is an isometric view of the luminaire of FIG. 1 shown with the lens removed.

FIGS. 1 and 2 illustrate a light fixture, or luminaire 100, for lighting a particular subject area. The luminaire 100 includes a housing 104. The housing 104 serves as a weather-proof enclosure for containing the necessary electronics 108 that control one or more LEDs and is preferably constructed at least partially of a thermally conductive material in order to function as a heat sink for extracting and dispelling heat produced by the electronics 108. The housing 104 is substantially symmetric about a central axis 110 and provides structure on which to mount further components described below.

A plurality of tabs 116 are mounted to the housing 104. The tabs 116 are spaced around the interior of the housing 104 and form an internal perimeter. Fastened to the tabs 116 are LEDs 120. The LEDs 120 can include any type of solid state light emitter or other directional light source and the term "LED" is not meant to be limiting in its application to the described embodiments. The LEDs 120 may emit light of a number of colors, though white light is preferable for most applications. One LED 120 is fastened to each tab 116, and the number of tabs 116, and hence LEDs 120, can number as many as can be made to practically fit along the aforementioned perimeter. The tabs 116 can be evenly or unevenly spaced around the perimeter. Even spacing will create a generally symmetric light pattern while uneven spacing will result in an asymmetric light pattern, the latter of which is desirable for certain applications. LEDs are directional with respect to light output, and the main centerline of each LED provides the direction of maximum LED beam candela. Each LED 120 of the presently described embodiment is generally positioned orthogonally facing the central axis 110 (i.e., 90° from nadir), such that its axis of greatest light intensity is coincident with the illustrated line 122 of FIG. 1. LEDs 120 can also be rotated up to 45° upward or downward from line 122 to further adjust the light pattern. The tabs 116 additionally facilitate the transmission of heat from the LEDs 120 to the housing 104 and also provide a datum to ensure proper directing of light emitted into the interior of the housing and to the reflectors, which are further described below. In other embodiments, the LEDs 120 can be mounted in other manners relative to the housing 104. The LEDs 120 are powered and driven through connections to the associated electronics 108 well known to those in the art.

Figure 3A:
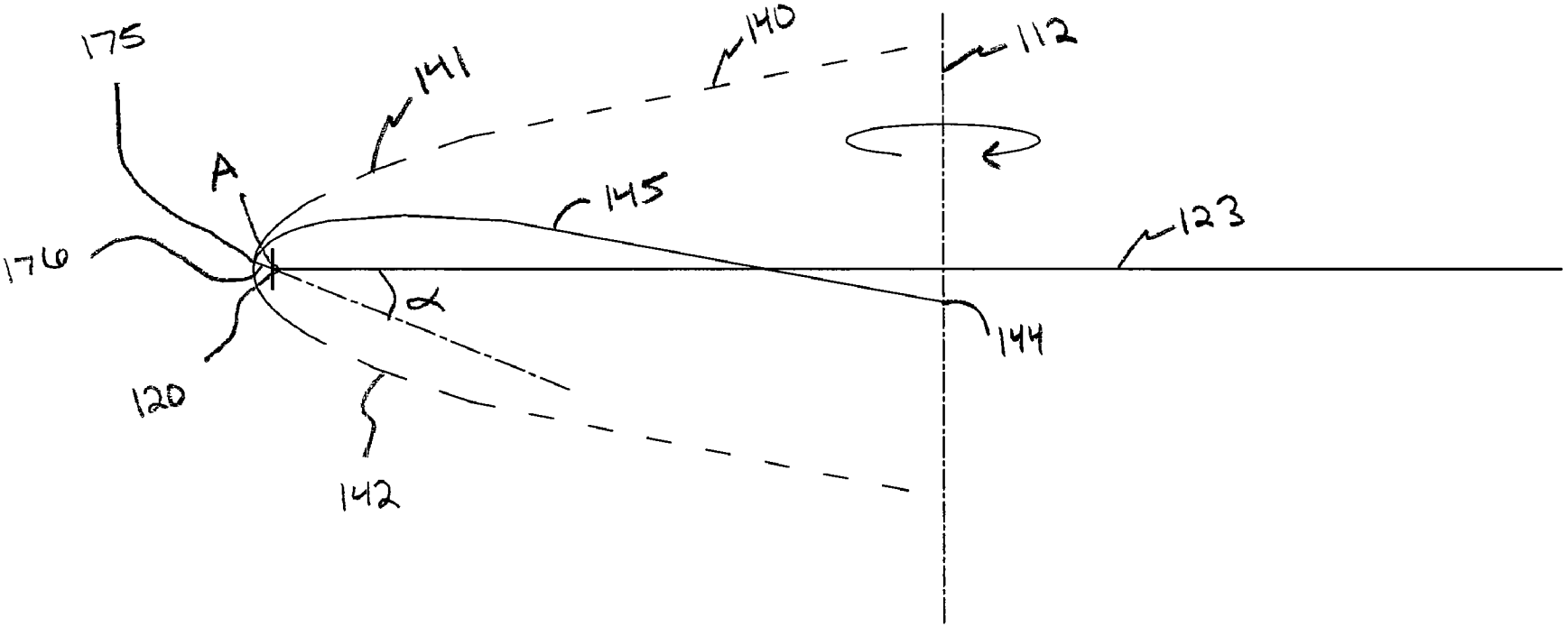
FIG. 3*a* is a cross section detailing the formation of a reflector of the luminaire of FIG. 1.
Figure 4:
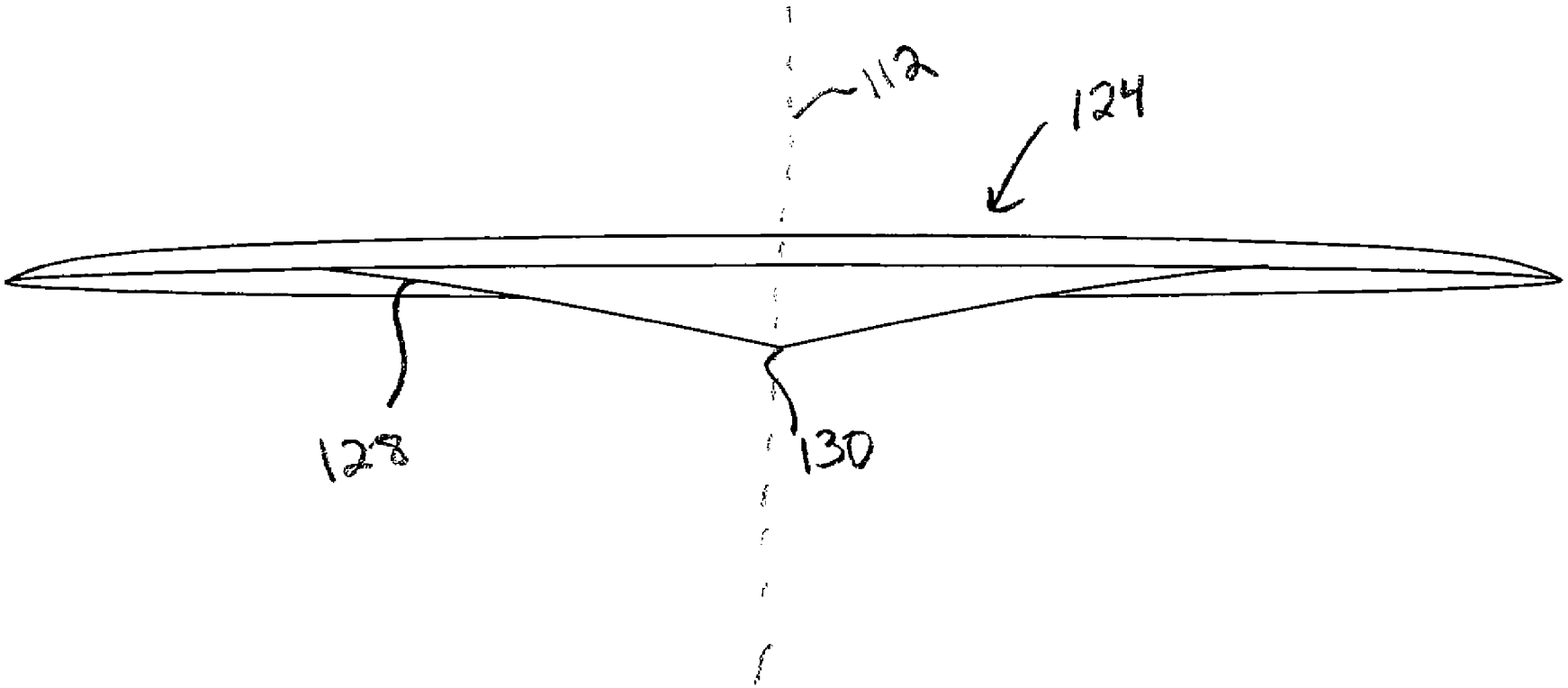
FIG. 4 is an isometric view of the reflector of FIG. 3*a*.

Positioned within the housing 104 is a reflector 124. The reflector 124, as a top or "ceiling" reflector, includes a bottom reflective surface 128. The reflector 124 is generally centered on a central axis 112, which in the illustrated embodiment is coincident with the central axis 110 of the housing 104. The central axis 112 corresponds to the line of sight of an observer viewing the luminaire 100 from directly above coincident with the point commonly referred to as the nadir on the illuminated area below. Referring to FIG. 3*a*, the reflector 124 can be described as formed from a parabolic or other conic cross section 140. The conic cross section 140 as shown includes a top half 141 and a bottom half 142 and has a focal point A, located at or about an LED 120 within the cross sectional plane of FIG. 3*a*. Geometrically, the bottom half 142 of the conic cross section 140 is truncated and the top half 141 is rotated about the focal point A clockwise (as shown in FIG. 3*a*) to an angle α. The angle α is determined by the desired angle of maximum beam candela, e.g., an IESNA Type V light has a preferred angle or angle range most desired for low bay lighting. The angle α in the presently described embodiment can range from about 15° to about 45° from a line 123 orthogonal to the central axis 112 (from about 45° to about 75° from nadir). Preferably the angle α is about 22° (about 68° from nadir). The resulting conic cross section portion 145 includes an end 144 such that the conic cross section portion 145 extends to, but does not extend across, the central axis 112. The LED 120 of FIG. 3*a* faces substantially away from the vertex 175 of the conic cross section portion 145. The conic cross section portion 145 is then revolved about the central axis 112 to form the bottom surface 128 of the reflector 124, as most clearly shown in FIG. 4. The revolution may extend a full 360°, but can be of a lesser magnitude depending upon the particular application. The bottom surface 128 is generally saucer-shaped and includes a centrally located peak 130, which is coincident with the central axis 112 when the reflector 124 is positioned within the housing 104. If necessary, one or more apertures in the reflector 124 can be formed to provide sufficient space for the tabs 116 and/or the LEDs 120 previously described (see FIG. 1). Further modification of reflector 124 by adjusting the geometry, surface finish, or both in the region near the LEDs 120 may also be required in order to adjust the light at or near nadir.

Figure 3B:
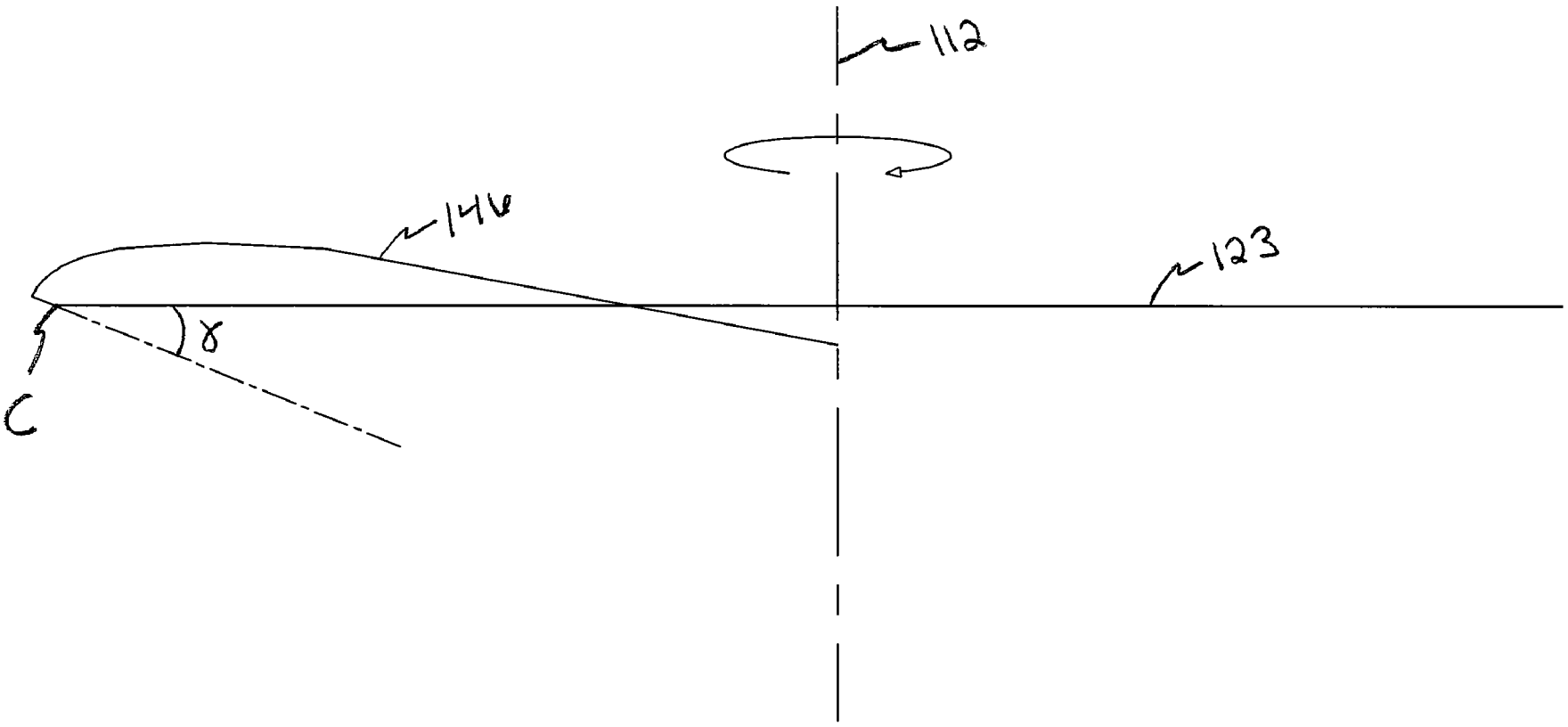
FIG. 3*b* is a cross section detailing the formation of a portion of the reflector of FIG. 3*a*.

The bottom surface 128 so formed in revolution can comprise two or more arcuate sections (not illustrated), each arcuate section spanning a specific and non-overlapping angle of revolution about the central axis 112. Each arcuate section can be further angled about the focal points of the cross sections comprising that arcuate section. Specifically, each arcuate section is made up of an infinite number of conic cross section portions, each of which can be rotated about its focal point C clockwise at an angle γ from the line 123 to produce a conic cross section portion 146, as shown in FIG. 3*b*, where the angle γ is of a different value than the angle α. The angle γ in the presently described embodiment can range from about 15° to about 45° (from about 45° to about 75° from nadir). Such a configuration allows for the select placement and spacing of multiple LEDs 120 to achieve specifically desired illumination patterns reflected from the bottom surface 128.

Figure 5A:
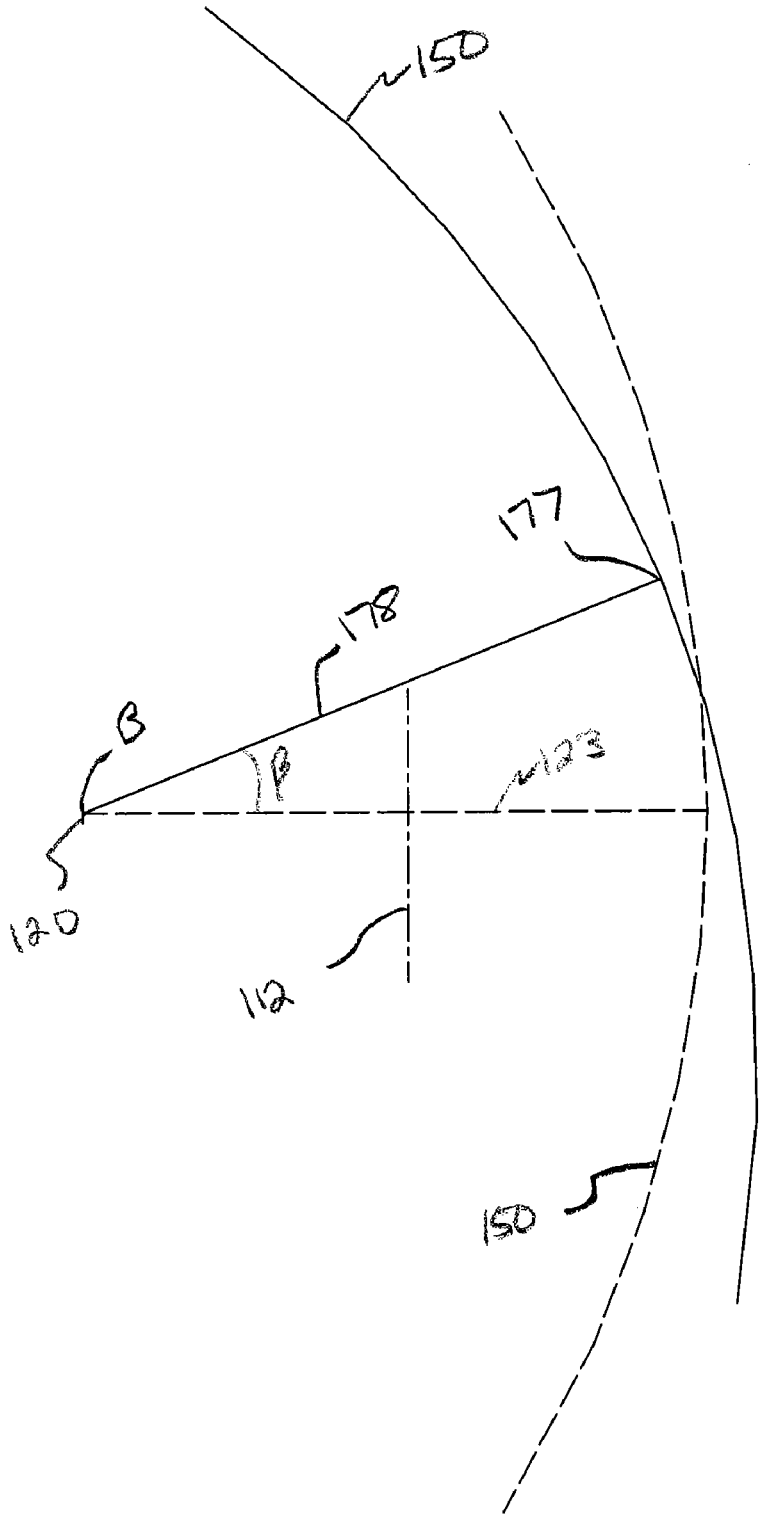
FIG. 5*a* is a cross section detailing the formation of another reflector of the luminaire of FIG. 1.
Figure 7:
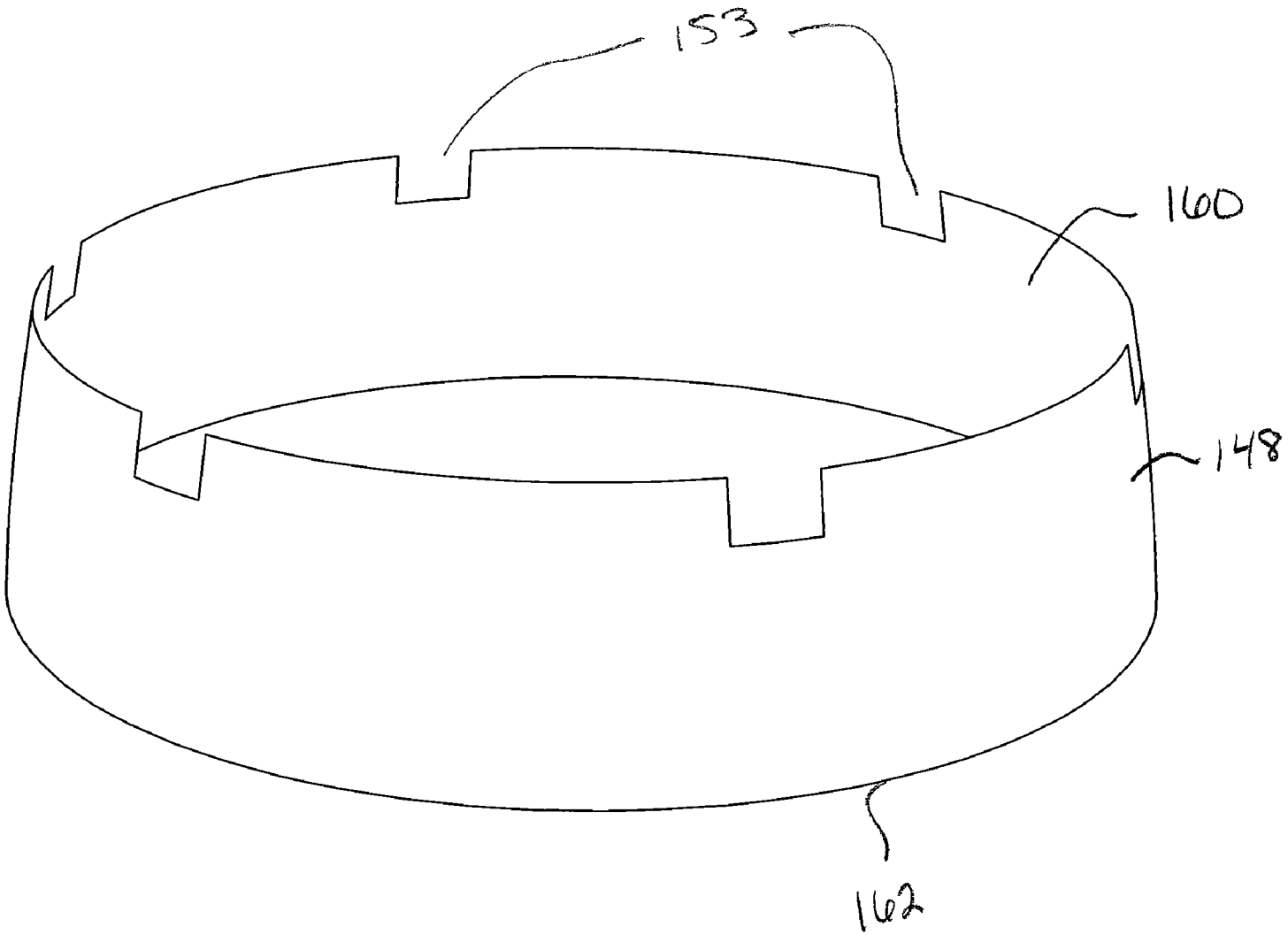
FIG. 7 is an isometric view of the reflector of FIG. 5*a*.

Referring back to FIGS. 1 and 2, also secured within the housing 104 is a generally ring-shaped reflector 148. The reflector 148 includes an annular reflective surface 160 that can be described as formed from a parabolic or other conic section 150, as shown in FIG. 5*a*. The conic cross section 150 has a focal point B, located at or about an LED 120 positioned on the opposite side of the central axis 112 from the conic cross section 150 within the cross sectional plane of FIG. 5*a*. Geometrically, the conic cross section 150 is rotated about the focal point B counterclockwise (as shown in FIG. 5*a*) to an angle β determined by the desired angle of maximum beam candela, as noted previously. The angle β in the presently described embodiment can range from about 15° to about 45° from a line 123 orthogonal to the central axis 112 (from about 45° to about 75° from nadir). Preferably the angle β is about 22° (about 68° from nadir). Referring to FIG. 6, the desired position of reflector 124, previously described, can be used to trim the top of the conic cross section 150 at a point 152. Additionally, a line 156 drawn continuously from the peak 130 at an angle α (see FIG. 3*a*) determines the lowermost extent of the conic cross section 150 as the point 157 at which the line 156 intersects the conic cross section 150, resulting in a conic cross section portion 158 having a finished vertical height H. The LED 120 of FIG. 5*a* faces substantially toward the vertex 177 of the conic cross section portion 158. This conic cross section portion 158 is revolved about the central axis 112 to form the annular reflective surface 160 with a bottom edge 162, an embodiment of which is shown in FIG. 7. The central axis 112 of the ring-shaped reflector 148 is the same central axis 112 on which reflector 124 is centered. The revolution may extend a full 360°, but can be of a lesser magnitude depending upon the particular application. As shown in FIG. 7, apertures 153 are formed in the reflector 148 to accommodate the tabs 116 and the LEDs 120. The reflector 148 can be modified to account for minor surface features and tolerances within the luminaire 100.

As conic cross section portion 145 has a focal point A located at or about an LED 120, and conic cross section portion 158 has a focal point B located at or about an LED 120 located on the opposite side of the central axis 112, focal point A can be coincident with focal point B, i.e., the focal point of both conic cross section portion 145 and conic cross section portion 158 may be located approximate the same LED 120.

Referring to FIG. 3*a*, a focal length 176 is defined as the distance between the focal point A and the vertex 175 of conic cross section portion 145. In the presently described embodiment, the focal length 176 can be approximately 5 mm in length. Referring to FIG. 5*a*, a focal length 178 is defined as the distance between the focal point B and the vertex 177 of conic cross section portion 158. In the presently described embodiment, the focal length 178 can be from approximately 320 mm in length to approximately 325 mm in length, and more particularly can be approximately 322 mm in length. The ratio of the focal length 178 to the focal length 176 in the presently described embodiment is approximately 64:1, however, in other embodiments the ratio of the focal length 178 to the focal length 176 may be greater than approximately 50:1.

Referring to FIGS. 1 and 2, the bottom edge 162 of the reflector 148 forms an aperture 164 through which light exits the luminaire and lights the subject area. The aperture 164 defines a transverse distance D, and the magnitude of the focal length of any conic cross section of the annular reflective surface 160 coincident with the central axis 112 is about 0.75 of distance D to about 1.0 of distance D, and can be approximately about 0.85 of distance D to about 1.0 of distance D, and can more particularly be approximately about 0.92 of distance D. In the illustrated embodiment, the transverse distance D defines a diameter of a circle, however, in other embodiments the edge defining the aperture 164 may not define a circle and could have other shapes.

Figure 5B:
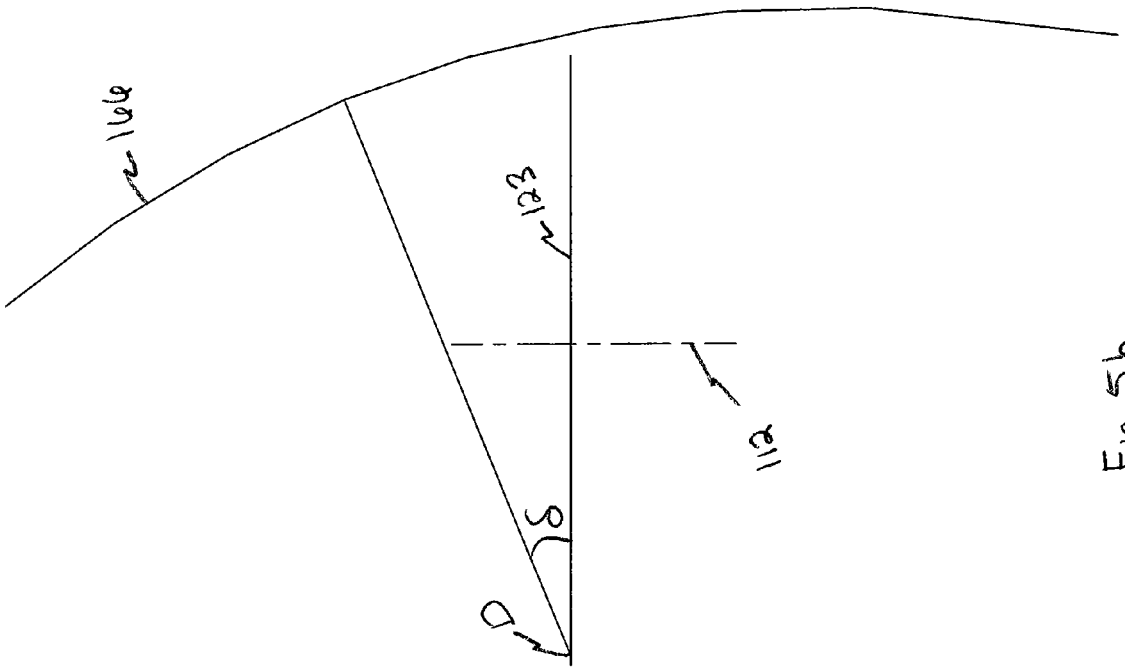
FIG. 5*b* is a cross section detailing the formation of a portion of the reflector of FIG. 5*a*.

The annular surface 160 so formed in revolution can comprise two or more arcuate sections (not illustrated), each arcuate section spanning a specific and non-overlapping angle of revolution about the central axis 112. Each arcuate section can be further angled about the focal points of the cross sections comprising that arcuate section. Specifically, each arcuate section is made up of an infinite number of conic cross section portions, each of which can be rotated about its focal point D counterclockwise at an angle δ from the line 123 to produce a conic cross section portion 166, as shown in FIG. 5*b*, where the angle δ is of a different value than the angle β. The angle δ in the presently described embodiment can range from about 15° to about 45° (from about 45° to about 75° from nadir). Such a configuration allows for the select placement and spacing of multiple LEDs 120 to achieve specifically desired illumination patterns reflected from the annular surface 160.

The reflectors 124, 148 can be constructed of any highly reflective material, typically defined as having 80% or greater reflectivity with a specular, semi-specular, or diffuse finish, though reflector 124 need not have an identical finish to that of reflector 148. A more specular finish will increase the peak candela values at the angles α, β, whereas more diffuse finishes provide less peak candela values but a smoother transition across the light pattern.

Optionally, as shown in FIG. 1, a lens 170 constructed of a clear material, such as plastic or glass, may cover the aperture 164. Such a lens 170 can include vertical flutes, not shown, to reduce glare and can also include pillows in the lens, not shown, to further manage light distribution. The lens 170 is attached to the housing 104 at 180 in a conventional manner.

Figure 8:
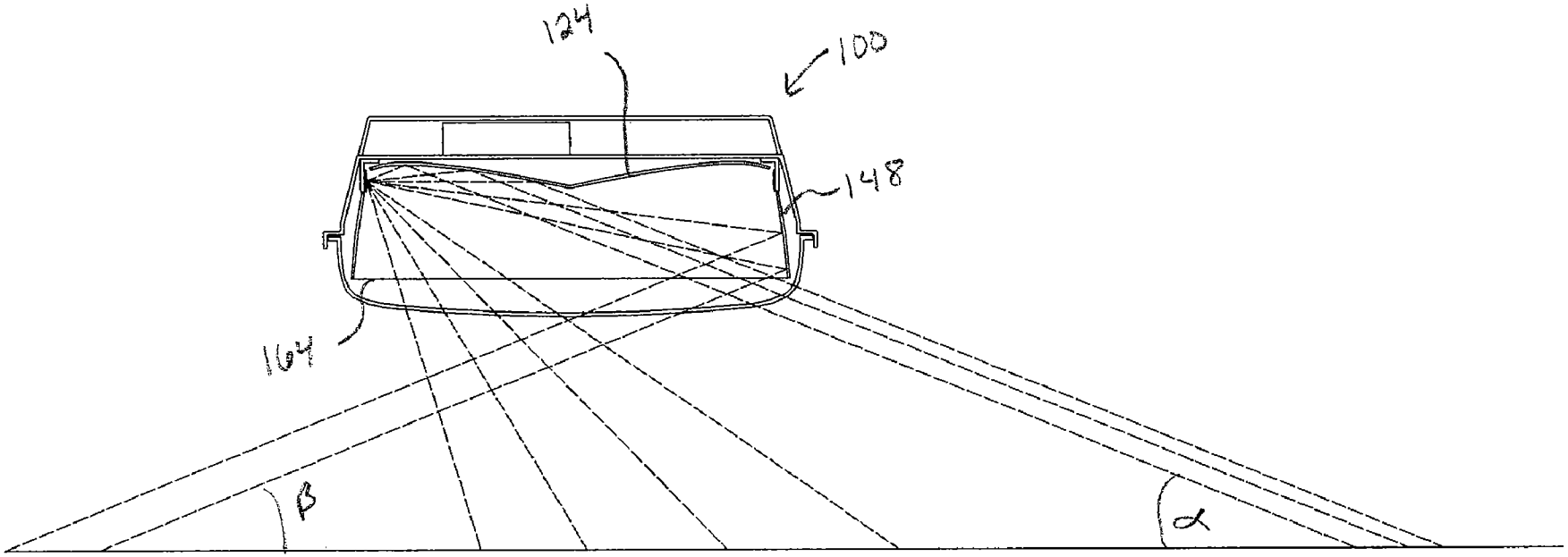
FIG. 8 is a cross-sectional view of the luminaire of FIG. 1 showing the resulting light rays in a single plane.
Figure 9:
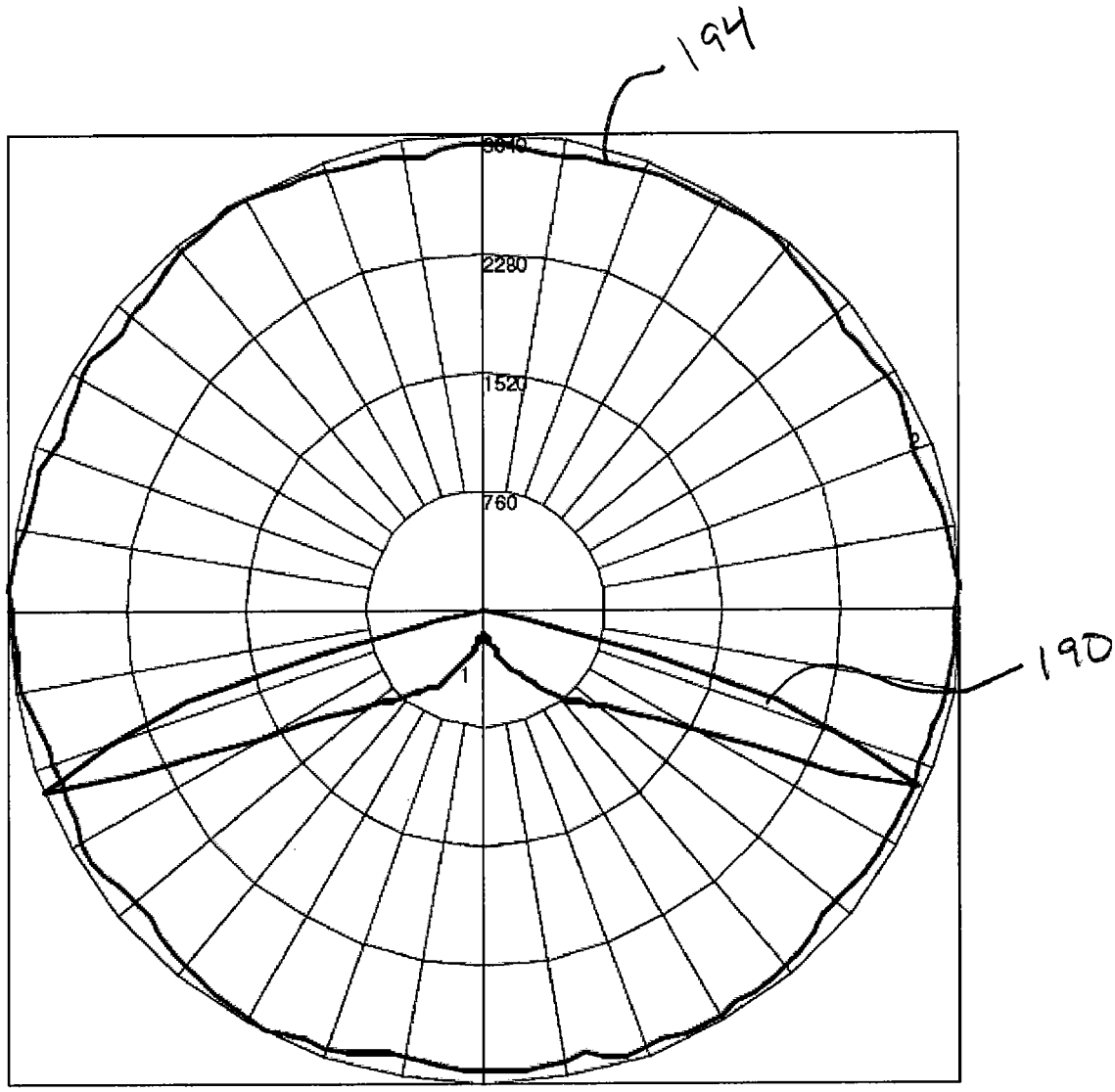

FIG. 8 shows the relationship between the light emitted by LEDs 120 and reflection of that light by reflectors 124, 128. Because of the directional nature of the LEDs 120 and their orientation within the housing 104, there is an inherent increase in beam candela as the angle from nadir increases irrespective of any contribution of the reflectors 124, 148. Light reflected from the reflectors 124, 148, further increases the light beam candela at increased angles from nadir. As illustrated, light reflected from the reflectors 124, 148 is concentrated at the angle α from the reflector 124 and at the angle β from the reflector 148, resulting from the rotation of conic cross section portions 145, 158 about focal points A, B, respectively. The angle α for the first reflector 124 need not be the same as the angle β for the second reflector 148. The described configuration allows for the light of maximum intensity reflected from the first reflector 124 to exit the aperture 164 without intersecting the second reflector 148 and therefore provide high beam candela at the angle α as previously described. Moreover, the vertical height H (FIG. 6) can be adjusted as necessary to set the cut-off angle of the fixture to meet the specific requirements for a non-cut-off, semi-cut-off, or full cut-off type of fixture, or to otherwise yield the desired light pattern. For example, the vertical height H can be adjusted such that light passing through the aperture 164 passes at an angle no less than 15 degrees from a line (e.g., line 122) orthogonal to the central axis 112. Any light reflected from the reflector 124 at an angle less than a will strike the second reflector 148 and be redirected through the aperture 164 at an angle approximating the desired angle β. Light directly below the fixture and up to the portion where light from the reflectors intersects the target area is provided by light directly from the emitters, but is less concentrated than the light reflected to the target areas. The resulting light pattern is that of an IESNA Type V light fixture, with a maximum beam candela occurring at the angle α and/or at the angle β, which, if the angle α equals the angle β, is preferably about 22° from horizontal (about 68° from nadir). Light patterns other than those of a IESNA Type V light are of course contemplated with the modifications previously described.

Figure 9:
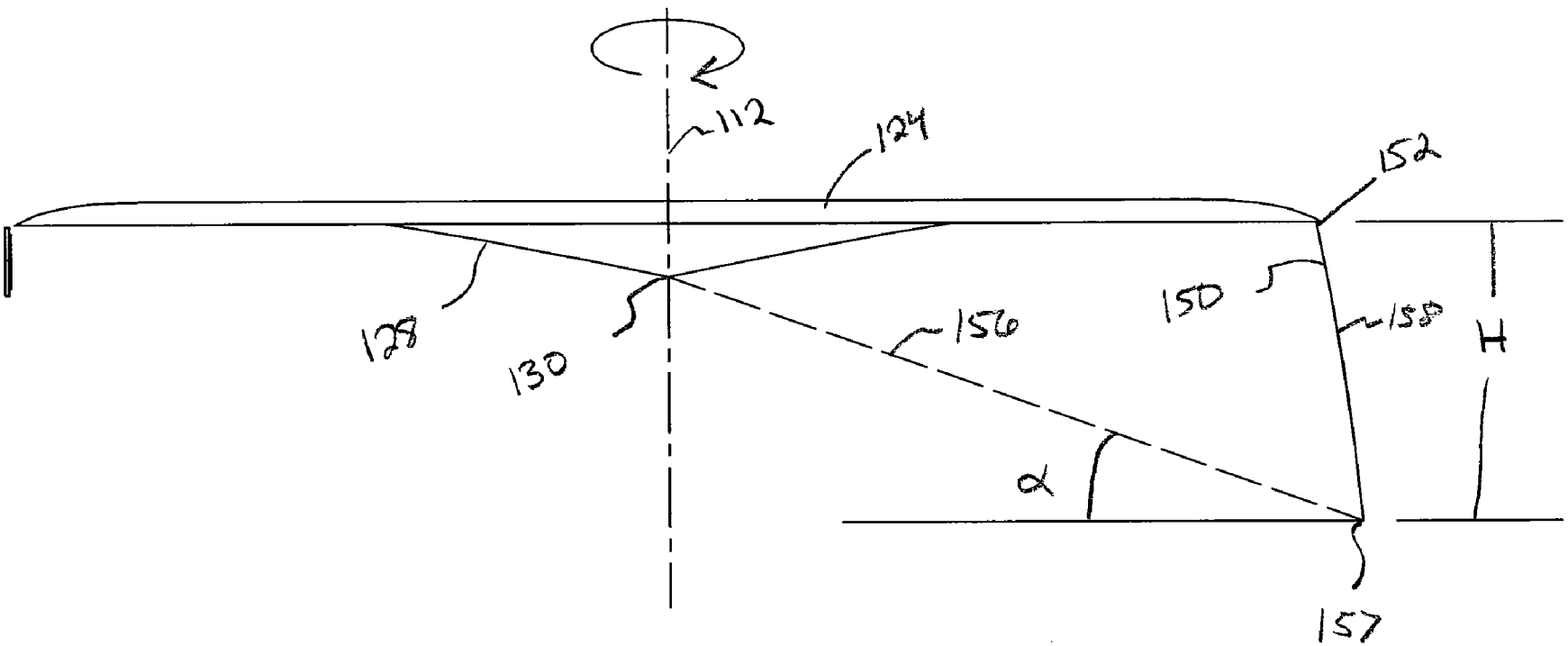
FIG. 9 is a polar candela plot of the light of a luminaire embodying the present invention.
Figure 10:
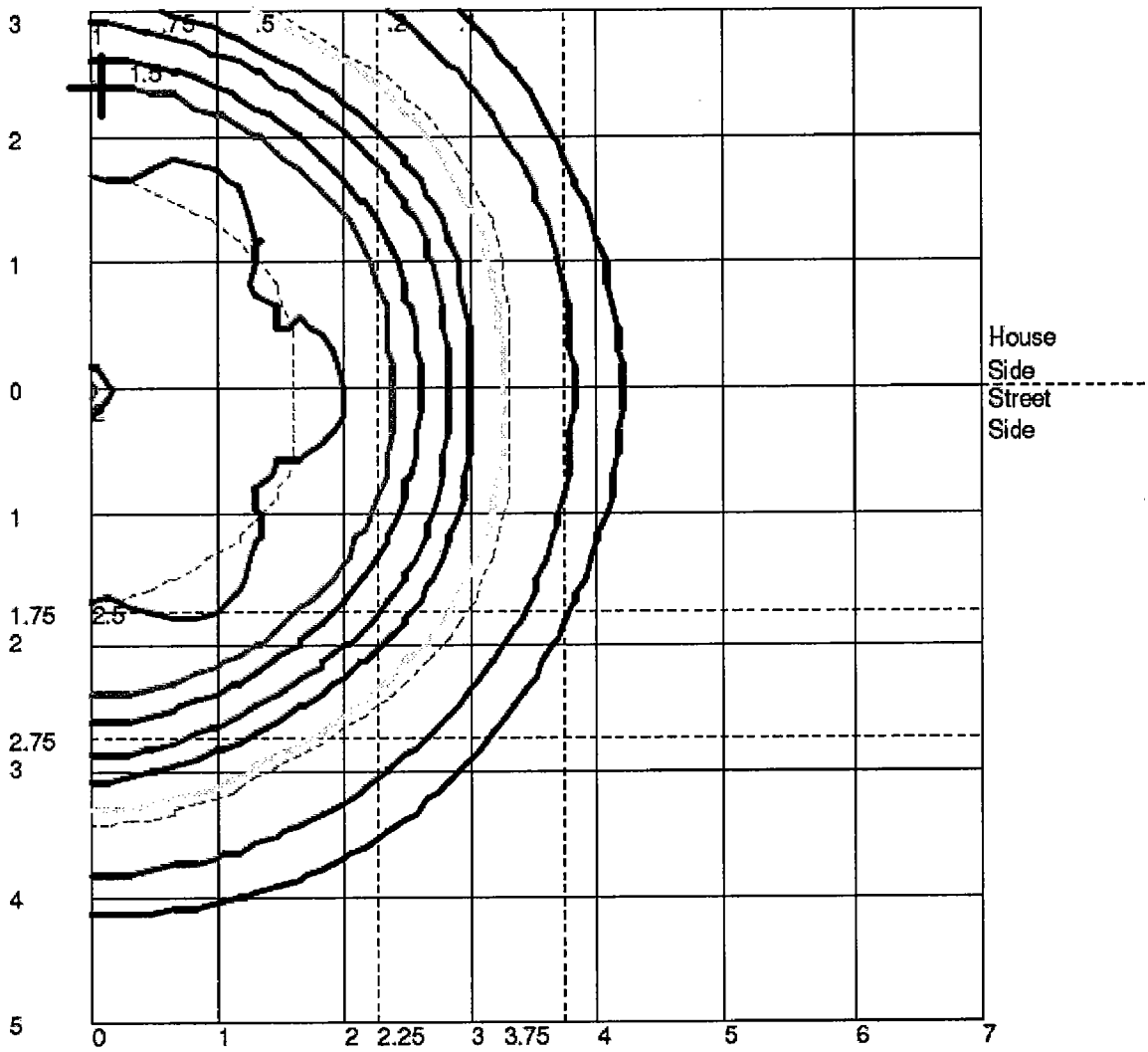
FIG. 10 is an iso-footcandle illumination plot of a luminaire embodying the present invention at a mounting height of nine feet.

FIG. 9 is a polar candela distribution plot of the output of the luminaire 100. Curve 190 is a plot of luminous intensity (candela) and shows the characteristic "batwing" candela profile previously discussed. Curve 194 is a plot of luminous intensity with respect to angular space viewed from above the luminaire 100. By their nature, both curves 190 and 194 are independent of the height above the ground of the luminaire 100. FIG. 10 is an iso-footcandle (ft-cd) distribution plot of the luminaire presently described and having a mounting height of nine feet. Various iso-footcandle lines of horizontal illuminance are illustrated with the graph axes representing distance in units of mounting height.

In additional embodiments the reflectors 124, 148 can be made by any method that closely approximates the reflective surfaces described. This can include breaking the surfaces into smaller flat or arcuate portions (facets) that allow the reflectors to be stamped or formed from pre-finished highly reflective materials in use by the lighting industry, and can certainly include any means to simplify the processes and tooling required to manufacture the reflectors.

Various features and advantages of the invention are set forth in the following claims.

The invention claimed is:

1. A luminaire for lighting an area, the luminaire comprising:

at least one LED;

a first reflector disposed substantially within a housing and including an annular reflective surface having a central axis and an edge defining an aperture through which light exits, the aperture defining a transverse distance D, the annular surface formed from a first conic cross section portion revolved about the central axis, one of the at least one LED facing the central axis and positioned proximate a focal point of the first conic cross section portion, the first conic cross section portion having a focal length between about 0.75 of transverse distance D and about 1.0 of transverse distance D; and a second reflector within the housing and having a bottom reflective surface formed from a second conic cross section portion extending to and revolved about the central axis, wherein the focal point of the second conic cross section portion is proximate the one of the at least one LED.

2. The luminaire of claim 1, wherein the focal length is between about 0.85 of distance D and about 1.0 of distance D.

3. The luminaire of claim 1, wherein the focal length is about 0.92 of distance D.

4. The luminaire of claim 1, wherein the one of the at least one LED positioned on a focal point of the first conic cross section portion facing the central axis is facing in a direction orthogonal to the central axis.

5. The luminaire of claim 1, wherein the at least one LED includes a plurality of LEDs, each of which is positioned proximate a focal point of a respective conic cross section portion of the annular reflective surface.

6. The luminaire of claim 1, wherein the first conic cross section portion and the second conic cross section portion are revolved 360° about the central axis.

7. The luminaire of claim 1, wherein the first reflector is formed from a plurality of flat portions that closely approximate the annular reflective surface and the second reflector is formed from a plurality of flat portions that closely approximate the bottom reflective surface.

8. The luminaire of claim 1, wherein the edge of the annular reflective surface is configured such that light passing through the aperture passes at an angle no less than 15 degrees from a line orthogonal to the central axis.

9. The luminaire of claim 1, wherein the first conic cross section portion is rotated about the focal point such that a line coincident with the focal length forms an angle $\beta$ with a line orthogonal to the central axis.

10. The luminaire of claim 9, wherein the angle $\beta$ is from about 15° to about 45°.

11. The luminaire of claim 10, wherein the angle $\beta$ is about 22°.

12. The luminaire of claim 9, wherein the annular reflective surface includes a first arcuate section spanning a first angle of revolution about the central axis and a second arcuate section spanning a second angle of revolution about the central axis, the second arcuate section comprising a plurality of third conic cross section portions, and wherein each and every one of the plurality of third conic cross section portions is rotated about its focal point such that lines coincident with the focal length of the each and every one of the plurality of third conic cross section portions each form an angle $\delta$ with a plane orthogonal to the central axis, the angle $\delta$ being a different value than the angle $\beta$.

13. The luminaire of claim 12, wherein the angle $\delta$ is from about 15° to about 45°.

14. The luminaire of claim 1, wherein the second conic cross section portion is rotated about the focal point such that a line coincident with the focal length forms an angle $\alpha$ with a line orthogonal to the central axis.

15. The luminaire of claim 14, wherein the angle $\alpha$ is from about 15° to about 45°.

16. The luminaire of claim 15, wherein the angle $\alpha$ is about 22°.

17. The luminaire of claim 14, wherein the bottom reflective surface includes a first arcuate section spanning a first angle of revolution about the central axis and a second arcuate section spanning a second angle of revolution about the central axis, the second arcuate section comprising a plurality of third conic cross section portions, and wherein each and every one of the plurality of third conic cross section portions is rotated about its focal point such that lines coincident with the focal length of the each and every one of the plurality of third conic cross section portions each form an angle $\gamma$ with a plane orthogonal to the central axis, the angle $\gamma$ being a different value than the angle $\alpha$.

18. The luminaire of claim 17, wherein the angle $\gamma$ is from about 15° to about 45°.

19. The luminaire of claim 1, wherein a ratio of the focal length of the first conic cross section portion to the focal length of the second conic cross section portion is greater than approximately 50:1.

20. A luminaire for lighting an area, the luminaire comprising:

at least one LED;

a first reflector disposed substantially within a housing and including an annular reflective surface having a central axis, the annular surface formed from a first conic cross section portion revolved about the central axis, the first conic cross section portion having a first conic cross section portion vertex, one of the at least one LED facing the central axis and substantially toward the first conic cross section portion vertex and further positioned proximate a focal point of the first conic cross section portion; and a second reflector within the housing and having a bottom reflective surface formed from a second conic cross section portion extending to and revolved about the central axis, the second conic cross section portion having a second conic cross section portion vertex, wherein the focal point of the second conic cross section portion is proximate the one of the at least one LED, the one of the at least one LED facing substantially away from the second conic cross section portion vertex.

* * * * *